US008214979B2

(12) United States Patent
Scruggs

(10) Patent No.: US 8,214,979 B2
(45) Date of Patent: Jul. 10, 2012

(54) SELF BORING VERTICAL BURIAL CONTAINERS

(76) Inventor: Donald E. Scruggs, Chino, CA (US)

( * ) Notice: Subject to any disclaimer, the term of this patent is extended or adjusted under 35 U.S.C. 154(b) by 0 days.

(21) Appl. No.: 13/136,962

(22) Filed: Aug. 16, 2011

(65) Prior Publication Data

US 2012/0000044 A1 Jan. 5, 2012

Related U.S. Application Data

(63) Continuation-in-part of application No. 12/587,550, filed on Oct. 8, 2009, now Pat. No. 8,046,883, and a continuation-in-part of application No. 11/477,236, filed on Jun. 28, 2006, now Pat. No. 7,631,404.

(51) Int. Cl.
*A61G 17/00* (2006.01)

(52) U.S. Cl. ..... 27/35; 52/128

(58) Field of Classification Search ..... 27/1, 2, 27/32, 35; 37/189, 300; 405/129.55; 588/250; 52/128, 133, 136
See application file for complete search history.

(56) References Cited

U.S. PATENT DOCUMENTS

| | | | | |
|---|---|---|---|---|
| 3,188,712 | A * | 6/1965 | Bauermeister | 27/6 |
| 3,581,452 | A * | 6/1971 | Jalbert | 52/133 |
| 3,681,820 | A * | 8/1972 | Jalbert | 27/7 |
| 3,898,718 | A * | 8/1975 | Eubank | 27/35 |
| 3,918,133 | A * | 11/1975 | Schmitz | 27/2 |
| 3,940,894 | A * | 3/1976 | Nunes | 52/129 |
| 4,328,606 | A * | 5/1982 | Nunes | 27/35 |
| 4,893,385 | A * | 1/1990 | Schrag | 27/35 |
| 5,127,112 | A * | 7/1992 | Brock | 27/1 |
| 5,733,066 | A * | 3/1998 | Myers | 405/129.35 |
| 7,127,783 | B1 * | 10/2006 | Poole et al. | 27/1 |
| 7,631,404 | B2 * | 12/2009 | Scruggs | 27/35 |
| 8,046,883 | B2 * | 11/2011 | Scruggs | 27/35 |
| 8,104,153 | B2 * | 1/2012 | Scruggs | 27/21.1 |
| 2002/0144383 | A1 * | 10/2002 | Spence | 27/35 |
| 2010/0037490 | A1 * | 2/2010 | Scruggs | 37/189 |
| 2011/0225855 | A1 * | 9/2011 | Scruggs | 37/300 |

* cited by examiner

*Primary Examiner* — William L. Miller

(57) ABSTRACT

A space saving burial container that bores its own interment hole and efficiently guides the cut away receiving material up and out of the hole to inter a fully secured body in a permanently natural upright position.

2 Claims, 1 Drawing Sheet

SELF BORING VERTICAL BURIAL CONTAINERS

CROSS-REFERENCE TO RELATED APPLICATIONS

Continuation in Part of Edged Non-Horizontal Burial Containers application Ser. No. 12,587,550 now U.S. Pat. No. 8,046,883 filed Oct. 8, 2009; and patent application Ser. No. 11/477,236 now U.S. Pat. No. 7,631,404 filed Jun. 28, 2006.

FEDERALLY SPONSORED RESEARCH

Not Applicable

SEQUENCE LISTING OR PROGRAM

Not Applicable

FIELD OF THE INVENTION

This invention relates to conserving cemetery space by using easy to install non-horizontal burial containers having lower foot end cutting edges which, when the container is rotated, cause the container to bore into earth or other receiving materials and thus do not require a large amount of land area or a large pre-dug rectangular hole.

BACKGROUND OF THE INVENTION

A common current interment practice is using a horizontal burial container and to first move a body to a mortuary where it is prepared for funeral services. In cases where a body is unclaimed, it is usually provided with minimum preparation and burial, paid for by public funds. A claimed body, after mortuary preparation, is usually placed in an aescetically pleasing casket and either displayed in an open casket funeral service or the casket alone is visible in a closed casket service. Often, after an indoor service the body and casket are moved to a prepared grave site in a cemetery, where a final service is performed.

At the prepared grave site the casket containing the body is set either on or in a box like crypt during a grave side funeral service, if one is conducted. None of these burial services need be changed for the use of a Self Boring Vertical Burial Container. Several types of the present invention are designed to be set on floral or otherwise decorated boxes for open or closed casket funeral services in an in door or out door environment.

Currently the prepared horizontal grave is often a rectangular excavation approximately four feet wide by seven and a half feet long by six and a half feet deep. Walkways are left on all sides of the grave for later visitors, making about 50 square feet of ground area to be set aside for each grave. A Self Boring Vertical Burial Container requires only about one third of the land area used for a current horizontal burial.

The removed receiving material from the current type horizontal grave excavation is usually piled next to the grave site and covered during a grave side funeral service, if one is conducted. After funeral services, the closed casket or burial container, often in a box like crypt, is lowered to the bottom of the prepared grave excavation and the removed receiving material is shoveled back into the excavation. Ground cover, such as grass, is then restored over the site. In a Self Boring Vertical Burial Container interment only a very small amount of ground cover is removed and needs to be replaced.

In current horizontal burials, additional digging and preparation is often done to provide for the installation of a headstone, plaque marker or monument and the installation of flower and flag receptacles for persons to later pay respects and honor the deceased. Flower and flag receptacles and provisions for plaques, markers and monuments, are regularly built into the hull sealing top capping devices or head pieces of Self Boring Vertical Burial Containers.

Cemetery properties are usually selected and developed in costly, but pleasant areas with level and softer earth or other receiving materials. Roads, landscaping, fences, monuments, statues, trees, ponds and other items are added for utility and aesthetics. The cost of each grave site, and thus each burial, is relative to the number of grave sites on the developed cemetery property. The business of a cemetery is based on the number of grave sites available in the cemetery. With the Self Boring Vertical Burial Container method a cemetery has about three times the potential grave sites as in current horizontal burial practice. In addition, the presently invented Self Boring Vertical Burial Containers can be readily installed in ponds, corners and steeply sloped land adding greatly to the available grave site total in a cemetery.

All in all, the Self Boring Vertical Burial Container method significantly reduces the cost of each grave site and each burial and provides for a tripling of the business potential for each existing old and new cemetery.

OBJECTS OF THE INVENTION

It is a main object of this invention to greatly reduce the cost of each grave site by significantly reducing the land area required for each burial.

It is another object of this invention to reduce the cost of a burial by significantly reducing the amount of excavation and replacement of receiving material.

It is also an object of this invention to reduce the secondary labor currently required to finish a grave-site after interment by providing for plaque, monument, flag and flower placement as an integral part of the hull sealing top capping device of the burial container.

OPERATING PRINCIPALS AND PREFERRED EMBODIMENT

The preferred embodiment of this invention is a Self Boring Vertical Burial Container with a strong hull, tapered from an upper head end, which is the end at the ground surface when the burial container is fully interred and where the head of the interred body is located, toward a lower foot end, which goes deepest into the ground and where the feet of the body are located at final interment, and with the burial container having cutting edges extending outward from the foot end significantly perpendicular to the longitudinal axis of the burial container and outward to a diameter larger than that of the upper head end of the burial container and having receiving material guides starting along the upper edges of the cutting edges and extending upward along the length of the hull to just below the shaped upper head end and the hull sealing top capping device of the burial container and to a diameter larger than that of the hull. When such a burial container is rotated in the correct direction the cutting edges at the lower foot end of the hull remove about the same volume of receiving material as can be guided up and out by the guides extending outward farther than the hull wall surface and creating space between the hull and the interment hole being bored by the burial container. Gripping arms on powered equipment attached onto a vehicle grip the burial container and a wrenching device is set over the shaped upper head end of the burial container. The gripping arms loosely hold the burial container in place while the wrenching device rotates the burial container to cause the cutting edges at the foot end of the burial container to remove ground or other receiving material and have the guides, which continue upward from the cutting edges to the head end of the burial container, guide the removed material up and out of the interment hole being bored and thus make an interment. The burial container, with the body inside, is then left in the ground. The body is not affected by the motion as it is securely encapsulated within the container to stand proudly tall for all time.

Figure 1:
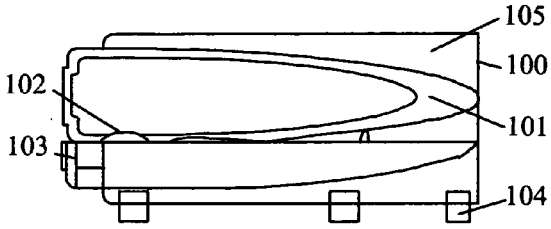
FIG. 1 is a side view of an open Self Boring Vertical Burial Container with self boring or self digging cutting edges, 100, and guides, 105, and a hull split lengthwise along the longitudinal axis of the burial container into an upper lid segment, 101, and a lower main section, 103, as is common practice in current coffins and caskets, with a body, 102, inside, and being stabilized and held level by blocks, 104, for funeral display.
Figure 2:
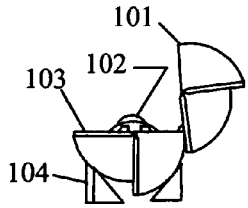
FIG. 2 is an end view looking from the lower foot end toward the upper head end of a Self Boring Vertical Burial Container illustrating the positions of a raised lid segment, 101, a body 102, a lower main section, 103, and support blocks, 104.
Figure 3:
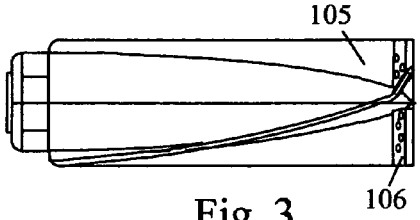
FIG. 3 is a side view of a Self Boring Vertical Burial Container in a closed position showing guides, 105, placed substantially lengthwise along the hull of the burial container so as to guide the cut away ground or receiving material to the surface, and added on cutting edges, 106, attached to the lower end of the guides.
Figure 4:
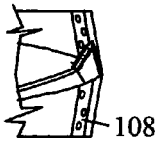
FIG. 4 is a side view of the foot end only of a Self Boring Vertical Burial Container with cutting edges, 108, set at an angle other than perpendicular to the longitudinal axis of the burial container, the longitudinal axis being from the head end to the foot end of the burial container.
Figure 5:
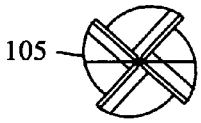
FIG. 5 is an end view of the lower foot end of a Self Boring Vertical Burial Container showing cutting edges and receiving material guides, 105.
Figure 6:
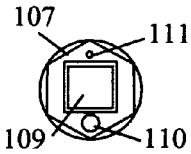
FIG. 6 is an end view of the top surface of a screw-in sealing top cap showing driven flats, 107, rectangular plaque or monument area, 109, flower receptacle, 110 and flag holder, 111.
Figure 7:
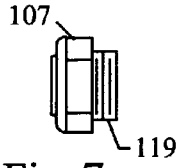
FIG. 7 is a side view of the screw-in sealing top cap shown in FIG. 6, which fits the hull depicted in FIG. 8, pointing out its driven flats, 107, and threads, 119, to match those inside a hull.
Figure 8:
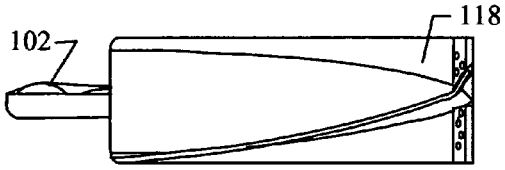
FIG. 8 is a side view of a single piece, non-split hull burial container with ground or receiving material guides, 118, and a body, 102.
Figure 9:
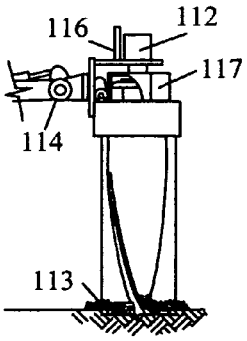
FIG. 9 is a side view of a Self Boring Vertical Burial Container being held by the gripping arms of a device, 116, on the end of a vehicle arm, 114, and being revolved by a wrenching device, 117, driven in the correct direction by a drive motor, 112, with dug out ground or receiving material, 113, around the interment hole being bored by the cutting edges.
Figure 10:
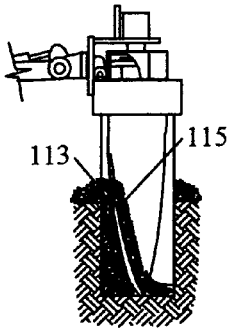
FIG. 10 is a cut away side view of a Self Boring Vertical Burial Container having been dug into ground or a receiving material with some dug out receiving material, 113, around the interment hole being dug by the cutting edges on the burial container and some dug away receiving material, 115, being guided upward and out through the space between the wall of the interment hole and the hull by guides extending out from the hull.
Figure 11:
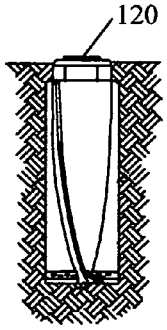
FIG. 11 is a cut away side view of a Self Boring Vertical Burial Container, now fully interred, showing its sealing top cap, 120, in its final position after the receiving material around the hull has been tamped, the surplus removed and the ground cover restored.

I claim:

1. A non-horizontal burial container that is rotated about its longitudinal axis to cut away receiving material to bore its own interment hole comprising:

a hull sealing top capping device; and a hull with at least one cutting element extending outward from a lower foot end of the hull substantially perpendicular to the longitudinal axis of the hull to a distance greater than the distance from the longitudinal axis of the hull to the farthest outward point on an upper head end of the hull, and with a receiving material guide element extending upward along the length of the hull from the cutting element to the upper head end of the hull and extending outwardly from the hull to a distance greater than the distance from the longitudinal axis of the hull to the farthest outward point on the upper head end of the hull to give the cutaway receiving material space to be guided upward and out of the interment hole being bored by the burial container.

2. A non-horizontal burial container that is rotated about its longitudinal axis to cut away receiving material to bore its own interment hole comprising:

a hull sealing top capping device; and a hull with at least one cutting element and an adjoining guide element extending substantially outward from the hull to a distance greater than the distance from the longitudinal axis of the hull to the farthest outward point on an upper head end of the hull to give the cutaway receiving material space to be guided upward and out of the interment hole being bored by the burial container, and with the guide element executing a spiral path along the hull as the guide element extends along the hull from the cutting element at a lower foot end of the hull to the upper head end of the hull.

* * * * *